US005393149A

United States Patent [19]

Iima

[11] Patent Number: 5,393,149

[45] Date of Patent: Feb. 28, 1995

[54] COLOR VIDEO PRINTER AND AN INK RIBBON CARTRIDGE USED THEREIN

[75] Inventor: Shin Iima, Tokyo, Japan

[73] Assignee: Sony Corporation, Japan

[21] Appl. No.: 42,798

[22] Filed: Apr. 6, 1993

[30] Foreign Application Priority Data

Apr. 20, 1992 [JP] Japan ..... 4-098405

[51] Int. Cl.[6] ..... B41J 35/28

[52] U.S. Cl. ..... 400/208; 400/249; 400/703

[58] Field of Search ..... 400/246, 216.2, 216.3, 400/208, 249, 708, 703

[56] References Cited

U.S. PATENT DOCUMENTS 4,790,677 12/1988 Kress ..... 400/249
4,970,531 11/1990 Shimizu et al. .
4,978,240 12/1990 Katsuno ..... 400/246
5,079,565 1/1992 Shimizu et al. .
5,290,114 3/1994 Asami et al. ..... 400/208

FOREIGN PATENT DOCUMENTS 0351515 1/1990 European Pat. Off. .
2184708 7/1987 United Kingdom .
2260516 4/1993 United Kingdom .

*Primary Examiner*—Edgar S. Burr
*Assistant Examiner*—John S. Hilten
*Attorney, Agent, or Firm*—Ronald P. Kananen

[57] ABSTRACT

A color video printing apparatus includes a reflection sensor detecting information marks on a mark-carrying section of a spool of an ink ribbon cartridge detachably mounted on the printing apparatus. A mark identification unit 36 identifies informations about the ink ribbon depending upon detection results which are transmitted from the sensor. A system controller selects a printing mode based on identification results transmitted from the mark identification unit 36 and then controls a mechanical controller according to the printing mode.

6 Claims, 3 Drawing Sheets

COLOR VIDEO PRINTER AND AN INK RIBBON CARTRIDGE USED THEREIN

BACKGROUND OF THE INVENTION

The present invention relates to a color video printing apparatus capable of identifying an ink ribbon cartridge detachably installed in the printing apparatus.

A color video printer and a detachable ink ribbon cartridge for use therein are well known in the art. An ink ribbon cartridge of a double-spool type includes a cartridge housing and supply and take-up spools accommodated in the cartridge housing. As the spools rotate, an ink ribbon wound about the supply spool is fed to the take-up spool and wound thereon.

There are provided various kinds of ink ribbons which are selectively used depending upon a printing operation mode such as multicolor or monochrome mode, a sort of a recording medium used, for instance a photographic paper, a sheet with a laminate film, a sheet adapted for an overhead projector (OHP), or others. Such ink ribbons include a substrate film and a melting or sublimating color layer formed on the substrate film. An ink ribbon For multicolor printing has a plurality of color blocks arranged in series in a spaced relation to each other. Each of the color blocks comprises segments arranged in a predetermined order, for example, yellow, magenta, cyan, and black colors. The segments are in turn printed on the sheet to form a multicolor image thereon.

A printing operation is performed in a sequence determined depending upon a kind of the ink ribbon selected. Therefore, the printer is required to be capable of identifying the kind of the ink ribbon accommodated in the ink ribbon cartridge.

It has been proposed to provide on a cartridge housing of the ink ribbon cartridge an information mark indicating a characteristic of the ink ribbon in order to identify the type of the ink ribbon. One example of the information mark is an optical mark attached to a peripheral outer surface of the cartridge housing. Light reflected on the optical mark is detected by an optical sensor disposed in the printer. Another type of the information mark is a protrusion or groove provided on the cartridge housing. The protrusion or groove is detected by a sensor installed in the printer.

Accordingly, in order to indicate various different pieces of information pertaining to the ink ribbon, a plurality of information marks must be provided on a limited area of the surface of the cartridge housing. Further, since many sensors must be provided for detecting many information marks, the printer necessitates a relatively large space in which the sensors are accommodated.

SUMMARY OF THE INVENTION

An object of the present invention is to provide a color video printing apparatus capable of identifying various different pieces of information relating to ink ribbon in an ink ribbon cartridge using the minimum number of sensors in a manner which reduces sensor-mounting space in the printing apparatus and further to provide a simple information bearing arrangement in the ink ribbon cartridge which is used in the printing apparatus.

According to one aspect of the present invention, there are provided in a color video printing apparatus in which an ink ribbon cartridge is detachably installed, the ink ribbon cartridge including a spool and an ink ribbon wound around the spool, the spool having at least one mark-carrying portion which is provided with a plurality of information marks, the color video printing apparatus including a printing head, a platen roller, a sheet feeder, driving devices for driving the printing head, the platen roller and the sheet feeder, and a detecting device for identifying the ink ribbon cartridge, the detecting device comprising:

- a sensor for detecting, in sequence, the information marks on the mark-carrying portion of the spool during one rotation cycle of the spool and producing detection signals, the information marks indicating information about the ink ribbon;
- means for identifying the informations about the ink ribbon in response to receipt of the detection signals and producing identification signals; and
- means for controlling the driving devices in response to receipt of the identification signals.

According to another aspect of the present invention, there is provided an ink ribbon cartridge for use in a color video printing apparatus, comprising:

- a cartridge housing;
- a spool rotatably disposed in the cartridge housing and having an ink ribbon wound thereabout; and
- at least one mark-carrying section disposed on the spool and having a plurality of information marks indicating information about the ink ribbon.

According to still another aspect of the present invention, there is provided a method of identifying information about an ink ribbon of an ink ribbon cartridge detachably mounted in a color video printing apparatus, the ink ribbon being wound on a rotatable spool, the method comprising steps of:

- detecting, in sequence, information marks provided on a mark-carrying portion of the spool during one rotation cycle of the spool and then producing detection signals, the information marks indicating information about the ink ribbon;
- identifying the informations about the ink ribbon in response to receipt of the detection signals and then producing identification signals; and
- controlling the printing apparatus in response to receipt of the identification signals.

DESCRIPTION OF THE PREFERRED EMBODIMENT

Figure 1:
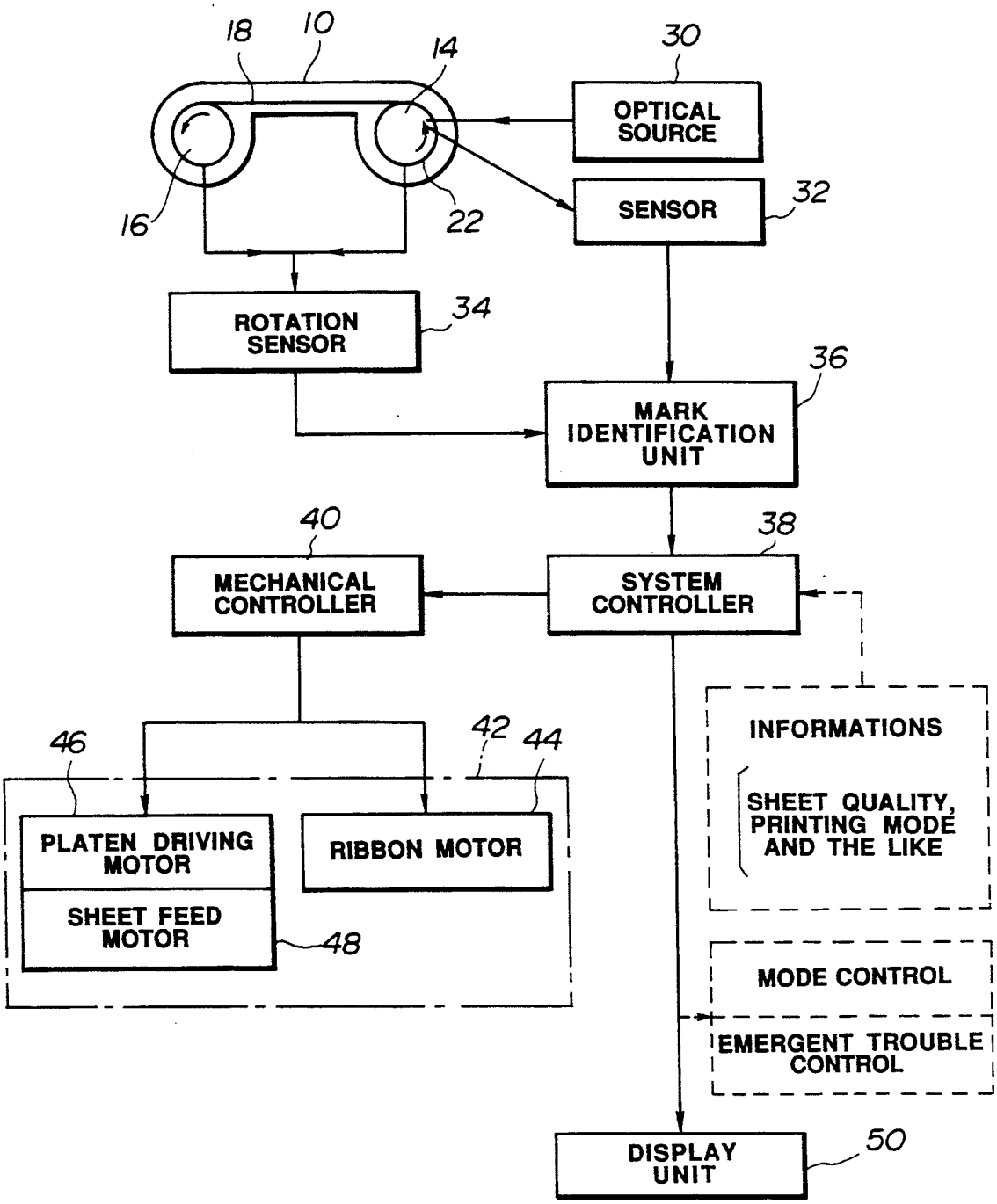
FIG. 1 is a block diagram of a preferred embodiment of a color video printing apparatus according to the present invention.

Referring now to FIG. 1, there is shown a block diagram of a preferred embodiment of a color video printing apparatus according to the present invention. The printing apparatus includes a housing (not shown) in which an ink ribbon cartridge 10 is detachably mounted.

Figure 2:
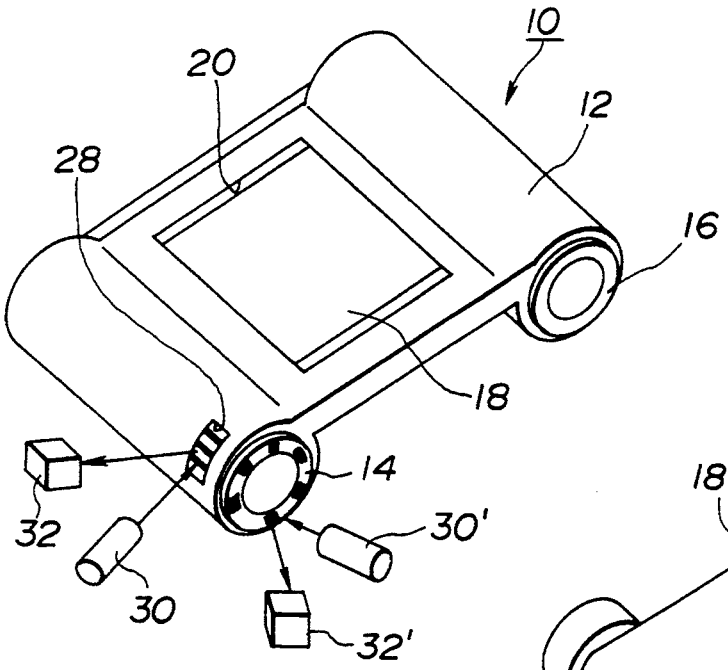
FIG. 2 is a perspective view of an ink ribbon cartridge used in the printing apparatus of FIG. 1, and a spool accommodated in the cartridge.
Figure 2:
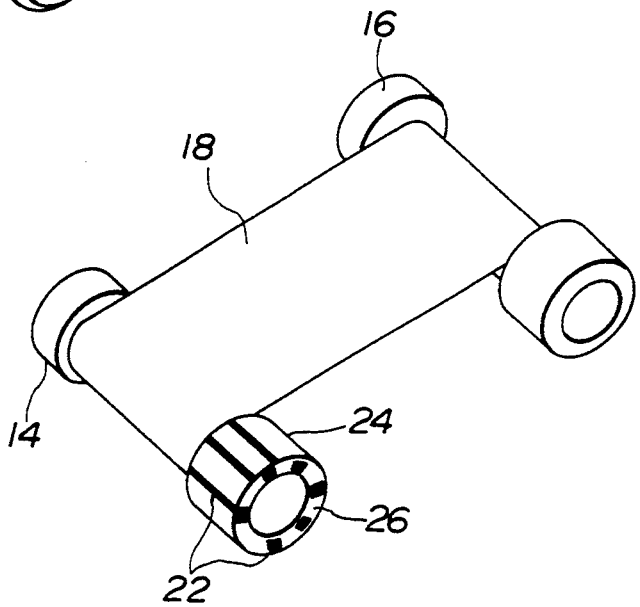

As shown in FIG. 2, the ink ribbon cartridge 10 includes a dumbbell-shaped housing 12 and supply and take-up spools 14 and 16 rotatably disposed within the housing 12. An ink ribbon 18 having a given length is connected at its both ends to the supply and take-up spools 14 and 16. As is well known in the art, the ink ribbon 18 includes a substrate and a heat-sublimatable color layer (neither shown in the drawings) applied onto the substrate. The color layer includes a plurality of color blocks each of which has color segments arranged in a predetermined order, for example, yellow, magenta and cyan. One color block is used for printing one sheet in the printing apparatus.

As the spools 14 and 16 rotate as indicated by arrows in FIG. 1, the ink ribbon 18 is transported from the supply spool 14 to the take-up spool 16. The spools 14 and 16 are rotatable in a reverse direction to that as indicated by the arrows of FIG. 1, when the ink ribbon 18 travels from the take-up spool 16 to the supply spool 14. The color layer of the ink ribbon 18 is exposed through a rectangular opening 20 formed on a flat central portion of the housing 12 which connects two cylindrical portions carrying the supply and take-up spools 14 and 16.

Figure 3:
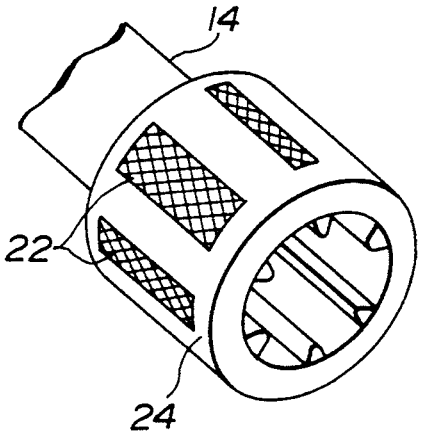
FIG. 3 is an enlarged perspective view of the spool of the ink ribbon cartridge, showing a first embodiment of information marks recorded on the spool.
Figure 4:
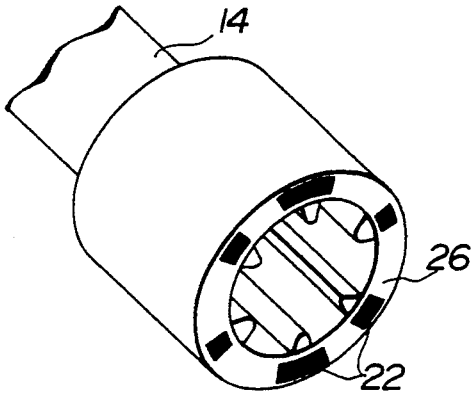
FIG. 4 is an enlarged perspective view of the spool, showing a second embodiment of the information marks.
Figure 5A:
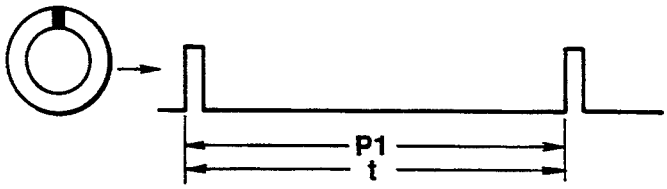
FIGS. 5(*a*), 5(*b*), 5(*c*), 5(*d*), 5(*e*) and 5(*f*) show code patterns of the information marks of the second embodiment and pulse shapes corresponding to the code patterns.
Figure 5B:
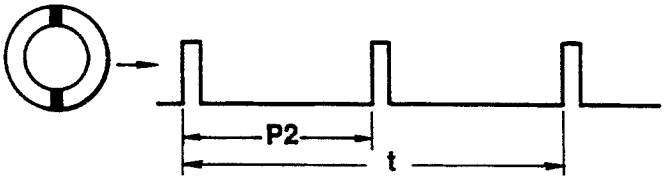
Figure 5C:
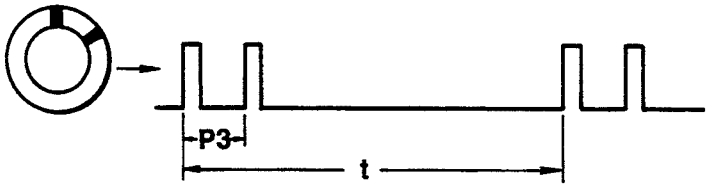
Figure 5D:
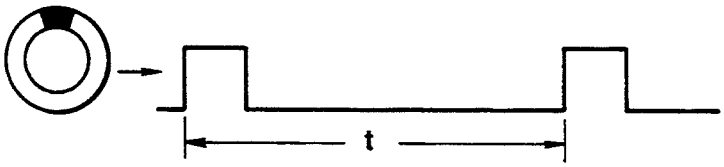
Figure 5E:
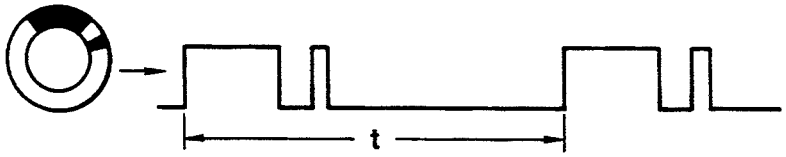
Figure 5F:
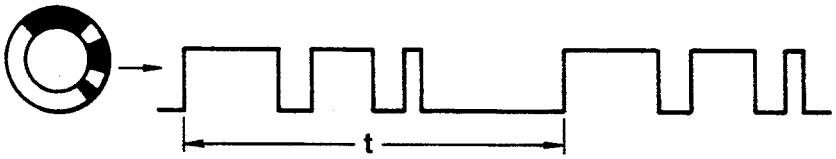

One of the supply and take-up spools 14 and 16 has a mark-carrying section 22 which is provided with information marks indicating information about the ink ribbon 18. In this embodiment, as shown in FIG. 2, the supply spool 14 has the mark-carrying section 22. For instance, the mark-carrying section is provided on a circumferential face 24 of one end portion of a cylindrical body of the supply spool 14 as seen in FIG. 3. The information marks on the mark-carrying section 22 are exposed through an aperture 28 formed on the peripheral surface of the cylindrical portion of the housing 12 in which the supply spool 14 is accommodated, 26 as seen in FIG. 2. Alternatively, the mark-carrying section 22 is provided on an annular end face 26 of the supply spool 14, as shown in FIG. 4. The information marks on the mark-carrying section 22 are in the form of an optical code pattern which is formed by applying an optical reflecting material onto the circumferential face 24 or annular end face 26 of the supply spool 14. The optical code pattern may be applied onto a film which is attached to the mark-carrying section 22 of the supply spool 14.

As shown in FIG. 2, the information marks are detected by a sensor 32 in cooperation with an optical source 30. Light emitted from the optical source 30 is reflected on the information marks and therefore the reflected light is detected by the sensor 32. The optical source 30 and the sensor 32 are arranged as seen in FIG. 2, depending upon the position of the mark-carrying section 22 on the supply spool 14. FIG. 2 shows the mark-carrying section 22 provided on both the circumferential face 24 and the annular end face 26 of the supply spool 14. Namely, in a case where the mark-carrying section 22 is provided on the circumferential face 24 on the supply spool 14, the optical source 30 is opposed to the aperture 28 of the housing 12 so as to emit light toward the mark-carrying section 22 exposed through the aperture 28. The sensor 32 is positioned so as to receive the light reflected on the information marks on the mark-carrying section 22. Upon the provision of the mark-carrying section 22 on the annular end face 26 of the supply spool 14, the optical source 30' is opposed to the end face 26 and therefore the sensor 32' is positioned such that the reflected light enters thereinto. The arrangement off the optical source and the sensor depends upon whether the mark-carrying section 22 is provided on tile circumferential face 24 or the annular end face 26 of the spool 14.

Now referring back to FIG. 1, during the rotations of the spools 14 and 16, the sensor 32 detects in sequence the light reflected on the information marks on the supply spool 14 and produces reflection signals. The reflection signals from the sensor 32 are transmitted to a mark identification unit 36 electrically connected to the sensor 32. The mark identification unit 36 determines the rotation number or rotation cycle of the spool 14 in response to receipt of the reflection signals. A rotation speed of the spool 14 is determined by the rotation number or rotation cycle of the spool 14 and a given transportation speed of the ink ribbon 18. An amount of a portion of the ink ribbon 18 wound on the spool 14, which has the color blocks used in the printing operation, is determined by the rotation speed of the spool 14. Accordingly, an amount of the remaining portion of the ink ribbon 18 having the color blocks which are not yet used in the printing operation, is determined.

The printing apparatus with the ink ribbon cartridge 10 also includes a rotation sensor 34 which detects the rotation of at least one of the spools 14 and 16 and produces rotation signals. The rotation signals from the sensor 34 are transmitted to the mark identification unit 36. The mark identification unit 36 receives the rotation signals and determines the rotation number or rotation cycle of the spool 14 or 16. An amount of the remaining unused portion of the ink ribbon 18 is determined in same manner as described above.

The amount of the unused portion of the ink ribbon 18 can be determined by only detection of the reflection signal from the sensor 32. In such a case, the sensor 34 can be dispensable.

The information marks recorded on the annular end face 26 of the supply spool 14 include code patterns as indicated at (a) to (f) on the left hand in FIG. 5. The code patterns (a) to (f) comprise a reflecting portion as indicated in black in FIG. 5, on which light from the optical source is reflected, and a non-reflecting portion as indicated as a blank region in FIG. 5. The reflecting and non-reflecting portions are replaceable with each other. As shown on the right hand in FIG. 5, a pulse shape is determined by the reflection signals produced each time the sensor 32 detects the reflecting portion of each of the code patterns (a) to (f). The spool 14 has one rotation cycle "t" as seen in FIG. 5.

The code pattern (a) has a short arcuate black portion and the remaining arcuate blank portion. Corresponding to the short arcuate black portion of the code pattern (a), the pulse shape has a pitch as indicated at "P1" in FIG. 5. One peak appears in the pulse shape in the rotation cycle "t" of the spool 14. The code pattern (b) has two short arcuate black portions which are diametrically opposed to each other. Corresponding to the two black portions of the code pattern (b), the pulse shape has a shorter pitch "P2" than the pitch "P1". Two peaks appear in an equidistant relation in the pulse shape in the rotation cycle "t". The code pattern (c) has two spaced arcuate black portions which are positioned in an acute-angled region on the annular end face 26. Corresponding to the spaced black portions of the code pattern (c), the pulse shape has a shorter pitch "P3" than the pitch "P2". Two peaks appear in an unequidistant relation in the pulse shape in the rotation cycle "t". The pitches "P1", "P2" and "P3" are used for indicating informations about the ink ribbon 18, respectively.

The code pattern (d) includes a longer arcuate black portion than the black portion off the code patterns (a) to (c). The code pattern (e) includes a combination of a long arcuate black portion and a short one. The code pattern (f) includes a combination of three arcuate black portions having different sectorial areas. The different combination types of the arcuate black portions with different sectorial areas indicate different information about the ink ribbon 18, respectively. The respective pulse shapes have peaks corresponding to the arcuate black portions of the code patterns (d) to (f) in the rotation cycle "t".

One of the code patterns (a) to (f) may be selectively used.

The mark identification unit 36 transmits, to a system controller 38, respective identification signals which indicate the rotation number or rotation cycle of the spool 14 and the informations about the ink ribbon 18, respectively.

The system controller 38 receives mode control signals indicating other information such as sheet quality, printing mode and the like. Depending upon these signals, the system controller 38 selects operational mode, operational sequence or another feature, and transmits a control signal to a mechanical controller 40. The mechanical controller 40 controls a printing mechanism 42 such that a suitable printing operation is performed depending upon the information about the sheet quality and the informations about the ink ribbon 18 and the like. The printing mechanism 42 includes a ribbon motor 44, a platen driving motor 46 and a sheet feed motor 48. The system controller 38 also controls a display unit 50 so as to indicate thereon an occurrence of an operational error or emergent trouble, should it occur.

When the printing apparatus with the ribbon cartridge 10 is energized, the sensors 32 and 34 activate to determine the rotation number of the spool 14 during rotation of the spool 14. Subsequently, the mark identification unit 36 identifies information about the ink ribbon 18 based on detection results by the sensors 32 and 34. The system controller 38 ascertains whether or not the ink ribbon 18 is suitable for printing a type of the sheet, depending upon the informations about the ink ribbon 18 and other information such as a quality or type of the sheet. If the ink ribbon 18 is unsuitable, the display unit 50 indicates such an unsuitable condition such as an operational error. Subsequently, the system controller 38 selects a printing mode based on the ascertaining results and then controls the mechanical controller 40. For example, upon using the ink ribbon 18 for printing a photographic sheet, the mechanical controller 38 actuates such that the color segments, yellow, magenta and cyan, of the color block of the ink ribbon 18 are in turn printed on the sheet. In the case of using the ink ribbon 18 for printing a non-photographic sheet or standard sheet, the mechanical controller 38 actuates such that a die diffusing layer is formed on the sheet prior to printing of the color segments.

What is claimed is:

1. In a color video printing apparatus in which an ink ribbon cartridge is detachably installed, said ink ribbon cartridge including a spool on which an ink ribbon is wound, said spool having opposed ends and an outer circumferential surface, said spool having first and second mark-carrying portions which are provided respectively with a plurality of first and second information marks, said color video printing apparatus including a printing head, a platen roller, a sheet feeder, driving devices for driving the printing head, the platen roller and the sheet feeder, and a detecting device for identifying the ink ribbon cartridge, said detecting device compromising:

a first sensor for detecting the first information marks on said first mark carrying portion;

means responsive to said first sensor for determining spool rotation and the amount of ink ribbon remaining on said spool;

a second sensor for detecting in sequence the second information marks on said second mark carrying portion of the spool during one rotation cycle of the spool and producing detection signals, said information marks indicating information about the kind of ink ribbon which is wound on said spool;

means for identifying the information about the kind of ink ribbon which is wound on said spool in response to receipt of the detecting signals and producing identification signals, one of said mark carrying portions being one of said opposed ends and the other one of said mark carrying means being one of said circumferential surfaces; and means for controlling the driving devices in response to the identification signals.

2. An ink ribbon cartridge for use in a color video printing apparatus comprising:

a cartridge housing;

a spool rotatably disposed in said cartridge housing and having an ink ribbon wound thereabout, said spool having opposed ends and an outer circumferential surface; and first and second mark-carrying sections disposed on said spool, each of said first and second mark-carrying sections respectively having a plurality of first and second information marks, said first and second information marks respectively providing information about the amount of ink ribbon on said spool and the kind of ribbon which is on said spool;

wherein one of said first and second mark-carrying sections is provided at one of said opposed ends of said spool; and wherein the other of said first and second mark-carrying sections is provided on said outer circumferential face of said spool.

3. A method of identifying information about an ink ribbon of an ink ribbon cartridge detachably mounted in a color video printing apparatus, said ink ribbon being wound on a rotatable spool, said method comprising the steps of:

detecting a first set of information marks which are provided on said rotatable spool, said spool having opposed ends and an outer circumferential surface;

determining, in response to the detecting of said first information marks on a first mark carrying portion of said spool, the rotation of the spool and the amount of ink ribbon remaining on said spool;

detecting in sequence a second set of information marks provided on a second mark-carrying portion of the spool during one rotation cycle of the spool and producing detection signals, said information marks indicating information about the kind of ink ribbon which is wound on said spool, one of said mark carrying portions being one of said opposed ends and the other one of said mark carrying means being one of said circumferential surfaces;

identifying the information about the kind of ink ribbon wound on said spool in response to the receipt of the detection signals and producing identification signals; and controlling the printing apparatus in response to the identification signals.

4. An ink ribbon cartridge for use in a color video printing apparatus comprising:

a cartridge housing;

a spool rotatably disposed in said cartridge housing and having an ink ribbon wound thereabout;

first and second mark-carrying sections disposed on said spool, each of said first and second mark-carrying sections respectively having a plurality of first and second information marks, said first and second information marks respectively providing information about the amount of ink ribbon on said spool and the kind of ribbon which is on said spool;

an aperture formed in said cartridge; and first and second sensors for reading said first and second mark carrying portions;

wherein only one of said first and second mark carrying sections is arranged to be read through said aperture by one of said first and second sensors.

5. An ink ribbon cartridge for use in a color video printing apparatus comprising:

a cartridge housing;

a spool rotatably disposed in said cartridge housing and having an ink ribbon wound thereabout, said spool having opposed ends and an outer circumferential surface; and first and second mark-carrying sections disposed on said spool, said first mark-carrying section having a first information mark providing information about the amount of ink ribbon on said spool, said second mark-carrying section having a second information mark providing information about the kind of ink ribbon which is on said spool;

wherein one of said mark carrying portions is one of said opposed ends and the other one of said mark carrying means is one of said circumferential surfaces.

6. An ink ribbon cartridge for use in a color video printing apparatus comprising:

a cartridge housing;

a spool rotatably disposed in said cartridge housing and having an ink ribbon wound thereabout;

first and second mark-carrying sections disposed on said spool, said first mark-carrying section having a first information mark providing information about the amount of ink ribbon on said spool, said second mark-carrying section having a second information mark providing information about the kind of ink ribbon which is on said spool;

an aperture formed in said cartridge; and first and second sensors for reading said first and second mark carrying portions;

wherein only one of said first and second mark carrying sections is arranged to be read through said aperture by one of said first and second sensors.

* * * * *